United States Patent [19]

Brands et al.

[11] Patent Number: 4,784,897

[45] Date of Patent: Nov. 15, 1988

[54] COVER LAYER MATERIAL ON A BASIS OF MATTING OR FABRIC

[75] Inventors: Heinrich Brands, Duisburg; Siegfried Fiebig, Marktheidenfeld; Hans Schillings, Viersen, all of Fed. Rep. of Germany

[73] Assignee: Fiebig & Schillings GmbH, Marktheidenfeld, Fed. Rep. of Germany

[21] Appl. No.: 796,935

[22] Filed: Nov. 12, 1985

[30] Foreign Application Priority Data

Mar. 12, 1984 [DE] Fed. Rep. of Germany ..... 3408932

[51] Int. Cl.[4] ..... B32B 9/00; B32B 5/16

[52] U.S. Cl. ..... 428/219; 428/281; 428/283; 428/328

[58] Field of Search ..... 428/250, 921, 304.4, 428/242, 283, 703, 219, 220, 240, 241, 243, 281, 328

[56] References Cited

U.S. PATENT DOCUMENTS

| | | | |
|---|---|---|---|
| 4,371,579 | 2/1983 | McCaskey et al. | 428/242 |
| 4,394,411 | 7/1983 | Krüll et al. | 428/703 |
| 4,567,093 | 1/1986 | Gogabe et al. | 428/250 |
| 4,606,958 | 8/1986 | Haq et al. | 428/316.6 |

FOREIGN PATENT DOCUMENTS

| | | | |
|---|---|---|---|
| 1151519 | 8/1983 | Canada | 428/921 |
| 3120342 | 12/1982 | Fed. Rep. of Germany . | |
| 61641 | 6/1978 | Japan | 428/921 |
| 1160891 | 8/1969 | United Kingdom . | |

*Primary Examiner*—William J. Van Balen
*Attorney, Agent, or Firm*—Felfe & Lynch

[57] ABSTRACT

The invention relates to a cover layer material on a basis of matting or fabric for the production of boards made of fluid or fluid-containing starting components and provided with cover layers, especially for the production of gypsum boards and polyurethane (PU) hard foam boards and their use in a continuous board producing apparatus.

15 Claims, No Drawings

COVER LAYER MATERIAL ON A BASIS OF MATTING OR FABRIC

This application is a continuation of international application PCT/DE85/00078 filed Mar. 12, 1985, with the United States as a designated state, published Sept. 26, 1985 as WO85/04199.

BACKGROUND OF THE INVENTION AND THE INVENTION

Boards provided with cover layers on both sides, such as gypsum board and foam boards made of polystyrene, polyurethane or urea-formaldehyde resins are widely used as structural components such as roof elements and for thermal and acoustical insulation, and as packing material.

These materials are today produced to a very great extent in a continuous process in so-called board plants in which the foaming is performed between revolving board belts, while the core material or its formation from liquid components, as for example in the case of polyurethane foam, is shaped against these revolving board belts. To prevent adhesion to these revolving board belts, paper layers accompany the upper and lower board belts in contact therewith. These layers bond to the core material, i.e., the polurethane foam for example, and usually also remain on them as bilateral cover layers, because the board thus made thereby gains stability and strength, and also the surface quality improves. It has already been proposed to use webs of matting or fabric as cover layer materials, such as mats or fabrics of cellulose fibers, polyester fibers and, glass fiber mats or fabrics on account of their incombustibility. Another advantage of such cover layers of matting or fabric consists in the fact that the core material, such as the polyurethane foam, is able to penetrate the interstices present in them and thus a good anchoring between core material and cover layer material is assured. The bond between core and cover layer material of paper or film has always been problematical. Nevertheless, matting and fabric materials have not succeeded as cover layer material, because the liquid components penetrate through the interstices present in the matting or fabric and result in adhesion to the board bands. Such liquid or liquid-containing starting components are present especially in the manufacture of PU hard foams, but also in urea-formaldehyde foam materials in which the starting materials set or react chemically, and in the manufacture of gypsum boards which set hydraulically.

An attempt has been made to remedy this disadvantage by coating the matting or fabric materials with polyethylene or bitumen, it being necessary in the latter case to sprinkle the cover layer additionally with sand to enable it to be handled. It is disadvantageous in these known materials, however, that both polyethylene and bitumen penetrate rather strongly into the matting or fabric, which thereby loses its open structure, and the bond between matting or fabric and the core of the material forming the board thus becomes insufficient. In the case of PU hard foam boards, on the example of which the invention is described below, there is another disadvantage in the fact that both materials are easily combustible, and thus the PU hard foam board made therefrom and provided with cover layers has extremely poor properties with regard to its behavior wh.

Therefore there exists an urgent technical need for a cover layer material which does not have the disadvantages indicated above, which permits the continuous production of boards from liquid starting components without passing through the matting or fabric and sticking to the boards or webs. Such a cover layer material is furthermore to conform in its behavior in contact with fire as closely as possible with building material group B2 or B1, but if possible even with building material group A2. It is furthermore to be resistant to hot bitumen, so that the cover layer will not be destroyed by the tarring so frequently performed on flat roofs, for example, and so that no formation of blisters, i.e., partial separation between the cover layer and PU hard foam, will occur.

This problem is solved by a cover layer material with the distinguishing features of the patent claim, which is characterized by the fact that the matting or fabric has on one side a coating of 70 to 94 wt.-% of a powdered inorganic material and 5 to 30 wt.-%, absolutely dry, of a binding agent; preferably the powdered inorganic material in the coating composition amounts to even 80 to 94 wt.-%, absolutely dry, of the total coating.

In DE-OS No. 31 20 342, with the object of achieving fire retardancy, an insulation body is described which has an outer skin composed of glass fiber matting and bearing a coating of at least one metal oxide such as aluminum hydroxide and/or antimony oxide and plastic copolymers. The requirements specified for the invention and set forth above cannot be satisfied by the technical teaching of this prior disclosure nor is the invention suggested by it. The content of metal oxide in the dried composition is between 50 and 70 wt.-%, the coating composition being applied in a pasty, foamed state to the glass fiber matting and then dried by radiant heat. Such a coating composition may satisfy the requirement of fire retardancy, but it does not provide the solution of the problem addressed herein. In the case of percentage contents of 50 to 70 wt.-% of inorganic material, these are concentrations of solids as they are commonly used in brushing and coating compositions. For the purpose pursued by the invention, such common coating compositions, with a high content of binding agent and liquid, are not suitable because liquid and binding agent strike through the matting or fabric and lead to the feared adhesion to the board belts of the continuous board machine. The considerable amounts of liquid to be removed also lead to bubbles and shrinkage in the drying process and the coating does not dry free of cracking.

For this reason a preferred method of producing the cover layer material consists in the use of a coating composition with a very high solids content, preferably of 70 to 80 wt.-%. Surprisingly, this coating can still be applied with a backfilling machine. It is best dried with hot, recirculating air and results in a perfectly impermeable coating without bubbles, shrinkage or cracking.

The advantage of the cover layer material according to the invention lies in the fact that, due to the unusually high content of inorganic material, the matting or fabric becomes impermeable to the liquid starting components, so that the open structure of the matting or fabric is preserved and good anchoring of the cover layer material to the core material of the plate during the later shaping and foaming is assured.

The high content of inorganic material furthermore brings it about that a PU hard foam web provided with this cover layer material is resistant to hot bitumen at, for example, 180°, the cover layer is not destroyed and no bubble formation occurs between cover layer and PU hard foam. Moreover, the high content of inorganic material further reduces inflammability below that of previously known materials.

The binding agents can be not only those on an inorganic basis, such as water glass, but also those on an organic basis, especially on a plastic basis. Since water glass as binding agent makes the cover layer rather brittle, mixtures containing binding agents of a plastic basis are also recommendable. In organic binding agents have the advantage that they further reduce inflammability.

The binding agents on the basis of plastic are preferably used in the form of plastic dispersions with a solids content of 35 to 70% by weight. They include especially polyvinylidene chloride and polyvinyl chloride, which have the advantage of being fire retardant, and copolymers and terpolymers of vinyl acetate with maleic acid and acrylic acid. Especially preferred on account of their good binding agent properties in comparison with the organic coating components, styrene-butadiene copolymers and polymers or copolymers of acrylic acid and methacrylic acid, respectively. The amount of plastic dispersion to be used depends to some extent on the solids content, and, to keep the energy required for the drying of the coating low, dispersions of the highest possible solids content are used.

The greatest variety of powdered substances are suitable as inorganic material, especially those on a mineral basis, such as silicates, clays etc. On account of its easy availability, calcium carbonate has proven to be especially preferred.

For the achievement of better values in relation to behavior on exposure to fire ["Brandverhalten"] aluminum hydroxide or alumina trihydrate is recommendable as an inorganic material, with which a fire retardancy rating of A2 can be achieved.

To remain economical, in a preferred embodiment of the invention the inorganic material consists of a mixture of 10 to 50 weight-percent of calcium carbonate and 90 to 50 weight-percent of aluminum hydroxide or alumina trihydrate. In this case, the higher the content of the aluminum hydroxide or the alumina trihydrate content is, the more fire-retardant the cover layer material and the PU hard foam board covered with it becomes.

It is desirable for the coating also to contain certain percentages of organic or mineral colorants for the purpose of distinguishing different quality classes of the board, for example with regard to fire retardancy. To counteract the translucency of the cover material and prevent light from showing through the often yellowish PU hard foam, coloring the cover material with carbon black has proven to be preferable, because even small amounts cover large areas.

For special applications, especially when a white cover layer material and thus a white PU hard foam board or white gypsum board is desired, the admixture of up to 5 weight-percent of titanium oxide powder, with respect to the total amount of inorganic material, has proven to be preferable.

The matting or fabric used for the cover layer material can best have a specific weight between 35 and 350 g/m$^2$, preferably from 40 g/m$^2$ to 150 g/m$^2$, and the applied weights of the coating are best between 150 and 450 g/m$^2$, these weights being dependent to a great extent on the application, the thickness of the core material, and other such factors. Glass fiber matting and fabric material has proven especially desirable as matting and fabric material, since it is incombustible. A matting and fabric material on a cellulose basis is desirable for use as a matting and fabric material on an organic basis. On account of its good strength rating, a polyester fiber matting is preferentially suitable. In the case of cover layer material for gypsum boards, it is desirable to use both nonwoven and woven fabrics together, because in this manner the liability to breakage of the gypsum boards can be very substantially reduced. Quite generally, the use of matting and woven fabric together can considerably increase the longitudinal and transverse strength.

Especially preferred is the use of the cover layer material according to the invention for the production of boards provided with cover layers on both sides in a continuous board producing plant using a top and bottom belt. It is also, of course, suitable for use as a laminating material for lamination, for example, onto polystyrene foam boards cut from a block of foam polystyrene, and here again the uncoated side of the matting or fabric is available for a good bonding of the cover layer material to the core material through the laminating material.

The invention will be further explained below through preferred examples relating to the method of manufacture of the cover layers:

Example 1

On a glass fiber mat having a specific weight of about 60 g/cm$^2$, a coating composition is applied in a backfilling machine, the composition consisting of $CaCO_3$ powder of a random average particle size of about 10 $\mu$m and of a polystyrene-butadiene dispersion with a solids content of 57% by weight, with the addition of 1.5 g of common adjuvants such as antifoaming agents, wetting agents and preservatives, the solids content of the coating composition amounting in all to about 75 wt.-%. At the same time the percentages of $CaCO_3$ powder and plastic dispersion in the coating composition are selected such that, after drying with hot circulating air in a drying tunnel, the coating consists of 92 wt.-% of inorganic material and 6.5 wt.-% of binding agent and the balance of adjuvants. The coating weight amounts to 250 g/m$^2$ absolutely dry.

Example 2

A mat on a cellulose basis treated for fire retardancy, having a weight of 50 g/m$^2$, is coated in a backfilling machine with a coating composition made of aluminum hydroxide, calcium carbonate, and a plastic dispersion made from a terpolymer of vinyl acetate, maleic acid and methacrylic acid ester, with a solids content of 50 wt.-% and 3 g of the common adjuvant, the solids content of the coating composition totaling about 73 wt.-%. The percentages of aluminum hydroxide, calcium carbonate and plastic dispersion in the coating composition are selected such that, after drying in hot circulating air in a drying tunnel, the coating consists of 60 wt.-% of aluminum hydroxide, 22 wt.-% of calcium carbonate, and 15 wt.-% of binding agent, balance adjuvants. The coating rate amounts to approximately 250 g/m$^2$ absolutely dry weight.

Example 3

To a mat composed of polyester fibers and weighing 40 g/m$^2$, there is applied a coating composition of 25 g of aluminum hydroxide, 43 g of calcium carbonate, 4 g of titanium dioxide, 8 g of a plastic dispersion of a terpolymer of vinyl acetate, maleic acid and methacrylic acid ester with a solids content of 57 wt.-% and approximately 1 g of common thickening, crosslinking and preservative agents, and 23 g of water, by means of a backfilling machine, and dried with hot circulating air in a drying tunnel. This cover layer material is characterized by its white color due to the use of titanium dioxide, and is used in the manufacture of white boards which are used a wall covering. The coating rate on the dried cover layer consists of about 270 g/m$^2$ absolutely dry weight.

We claim:

1. A cover layer material on a matting or fabric basis for the manufacture of boards from liquid or liquid-containing starting components, covered bilaterally with cover layers, especially for the manufacture of gypsum boards and polyurethane (PU) hard foam boards, said matting or fabric having on one side a coating of 70 to 94 wt.-% of a powdered inorganic material and 6 to 30 wt.-%, absolutely dry weight, of a binding agent.

2. The cover layer material of claim 1, wherein the powdered inorganic material in the coating amounts to 80 to 94% of the absolutely dry weight of the total coating.

3. The cover material of claim 1, wherein the binding agent is formed from a plastic dispersion with a 35 to 70% solid content by weight.

4. The cover material of claim 1, wherein the binding agent is formed from a latex on the basis of styrene-butadiene copolymers.

5. The cover material of claim 1, wherein the binding agent is formed from a latex on the basis of polymers or copolymers of acrylic acid or methacrylic acid.

6. The cover material of claim 1, wherein the inorganic material is calcium carbonate.

7. The cover material of claim 1, wherein the inorganic material is aluminum hydroxide or alumina trihydrate.

8. The cover material of claim 1, wherein the inorganic material is a mixture of 10 to 50% calcium carbonate and 90 to 50% aluminum hydroxide or alumina trihydrate.

9. The cover material of claim 1, wherein the coating contains organic or mineral coloring matter.

10. The cover material of claim 1, wherein the inorganic material additionally contains up to 5 weight-percent of titanium dioxide powder, with respect to the total amount of inorganic material, as mineral coloring matter.

11. The cover material of claim 1, wherein the matting or fabric has a specific weight between 35 and 350 g/m$^2$, and the application weight of the coating is between 150 and 450 g/m$^2$.

12. A method for the manufacture of the cover layer material according to claim 1, comprising applying a coating composition with a solid content of 70 to 80 wt.-% to the mat or fabric and drying said coating.

13. The method of claim 12, wherein the composition is applied by means of a backfilling machine and dried by means of circulating air drying.

14. A board covered on both sides with a cover layer material, said cover layer material being based on a matting or fabric, said matting or fabric having on one side a coating of 70 to 94 wt-% of a powdered inorganic material and 6 to 30 wt.-%, absolutely dry weight, of a binding agent.

15. The board of claim 14 in a continuous board production machine with top and bottom belt.

* * * * *